US005372190A

United States Patent [19]

Coleman

[11] Patent Number: 5,372,190

[45] Date of Patent: Dec. 13, 1994

[54] DOWN HOLE JET PUMP

[76] Inventor: William P. Coleman, 307 N. Rankin St., Apt. A, Natchez, Miss. 39120

[21] Appl. No.: 72,931

[22] Filed: Jun. 8, 1993

[51] Int. Cl.[5] ..... E21B 43/00; F04F 5/02

[52] U.S. Cl. ..... 166/68; 166/105; 417/172

[58] Field of Search ..... 166/105, 68; 417/172, 417/358

[56] References Cited

U.S. PATENT DOCUMENTS

| | | | |
|---|---|---|---|
| 2,291,911 | 8/1942 | McMahon | 417/172 |
| 4,293,283 | 10/1981 | Roeder | 417/172 |
| 5,055,002 | 10/1991 | Roeder | 417/172 |
| 5,083,609 | 1/1992 | Coleman | 166/68 |

FOREIGN PATENT DOCUMENTS

| | | | |
|---|---|---|---|
| 966324 | 10/1982 | U.S.S.R. | 417/172 |
| 972051 | 11/1982 | U.S.S.R. | 106/105 |
| 1161724 | 6/1985 | U.S.S.R. | 417/172 |

*Primary Examiner*—Hoang C. Dang
*Attorney, Agent, or Firm*—Jacobson, Price, Holman & Stern

[57] ABSTRACT

A down hole jet pump having various unique features which enables the pump to be used with various types of producing wells including those which produce gas along with a large ratio of water which may include considerable abrasive solid materials and can be run and retrieved inside coil tubing of relative small diameter as well as conventional threaded pipe of relatively small diameter. The embodiments of the jet pump disclosed enable the components of the jet pump to be retrieved by reversal to enable removal, replacement or adjusted to provide optimum operation of the pump in accordance with the installation requirements without the use of special tools.

12 Claims, 5 Drawing Sheets

DOWN HOLE JET PUMP

BACKGROUND OF THE INVENTION

1. Field of the Invention

The present invention generally relates to a down hole jet pump having various unique features which enables the pump to be used with various types of producing wells including those which produce gas along with a large ratio of water which may include considerable abrasive solid materials and can be run and retrieved inside coil tubing of relative small diameter as well as conventional threaded pipe of relatively small diameter. The embodiments of the jet pump disclosed enable the components of the jet pump to be retrieved by reversal to enable removal, replacement or adjusted to provide optimum operation of the pump in accordance with the installation requirements without the use of special tools. The embodiments of the invention are most closely related to my prior U.S. Pat. No. 5,083,609 issued Jan. 28, 1992 for down hole jet pump retrievable by reverse flow and well treatment system.

2. Description of the Prior Art

My prior U.S. Pat. No. 5,083,609 and the prior art made of record in that case disclose various procedures and apparatuses for production of underground fluid which include developments relating to down hole jet pumps which can be retrieved by reverse flow in the well. However, my prior patent and the prior patents of record in my prior patent do not disclose the specific structural details and operational characteristics of the embodiments of the down hole jet pump disclosed in this application.

SUMMARY OF THE INVENTION

An object of the present invention is to provide a jet pump that is specifically constructed to resolve problems associated with producing gas from wells which also produce large quantities of water containing considerable amounts of abrasive solid material with the pump also being used in other situations where previously known jet pumps could be used with the first disclosed embodiment of the pump being capable of being run and retrieved inside coil tubing or conventional threaded pipe of relatively small diameter with component parts of the pump being offset in a manner to provide maximum flow of the jet pump power fluid and production fluid.

Another object of the invention is to provide a down hole jet pump of compact construction for use in small diameter pipes or tubes in accordance with the preceding object in which the incorporating a diverter having an angled floor to provide an effective change of flow direction to provide maximum fluid flow in relation to the pump and related components.

A further object of the invention is to provide a down hole jet pump constructed of components to permit recovery of the standing valve and other components without the necessity of pulling the pump housing and power fluid tubing from the well.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
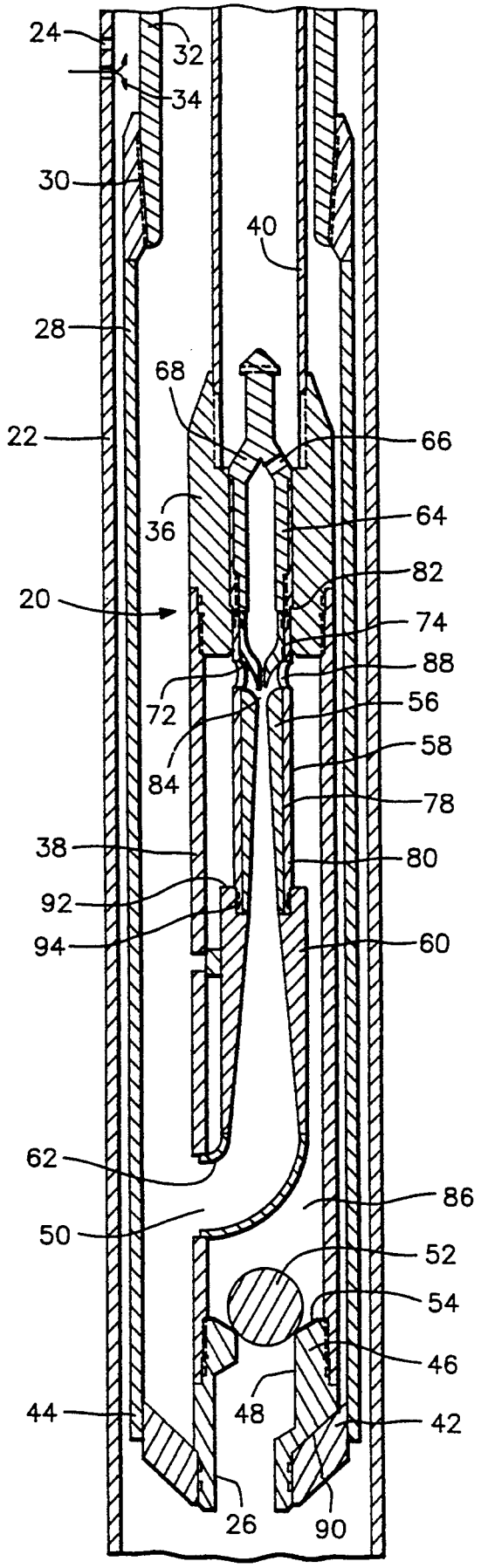
FIG. 1 is a longitudinal sectional view of the first embodiment of the down hole jet pump of the present invention.

Referring specifically to FIG. 1 of the drawings, the embodiment of the down hole jet pump disclosed therein is generally designated by reference numeral 20 and is disclosed in a well casing 22 of conventional construction having perforations 24 formed therein. The well casing may be conventional such as a 5½ inch outside diameter casing that has been cemented in the well and perforated at various levels or where a coal seam exists in a manner well known in the art. The coal seam contains methane gas and usually is associated with water, both fresh and salty and, in this case, the pump inlet 26 is set below the bottom perforations in order to encounter as little entrained gas as possible and to provide as much hydrostatic suction pressure to the pump as possible.

The pump includes a discharge housing 28 in the longitudinal member having a threaded connection 30 at its upper end to production tubing 32 which may be a conventional 3½ inch diameter tubing with the housing 28 and production tubing 32 run inside the casing 22 in a well known manner in concentric spaced relation which enable down flow of water in the space or annulus 34. The pump 20 includes housing components 36 and 38 with the upper component 36 of the housing being threadedly connected to threaded tubing or C.T. tubing 40 and the lower tubular component 38 of the pump housing being threaded to the component 36. The tubing 40 along with the pump is run inside the production tubing 32 with the tubing 40 having an outside diameter of 1½ inches or other diameters. The pump housing component 38 is threadedly connected to bottom offset nipple 46. Bottom plug 42 is welded to the bottom end of the discharge housing 28 as indicated at reference numeral 44. The nipple 46 includes an offset passageway 48 and is offset in a manner to enable the discharge port 50 in the pump housing component 38 to always be at the maximum possible distance from the inner wall of the discharge housing 28. Nipple 46 engages plug 42 when pump 20 is seated in housing 28 and is held on its seat 90 by the weight of the pump and tubing above.

While a discharge housing 28 has been disclosed, in some instances, it may not be necessary to utilize a discharge housing such as when the pump housing 20 is installed in tubing or casing with sufficient inside diameter and a packer, profile nipple, pump anchor or the like was available rather than a plug at the bottom of the pump housing to provide the necessary lower seal for the bottom of the pump housing in the same relative offset manner which would enable the pump housing to be installed directly in the tubing or casing rather than using a pump discharge housing 28.

As illustrated, the gas and water from the formation enter the well casing through the perforations 24 into the annulus 34 between the casing 24 and the production tubing 32 with gas traveling upward to be discharged into a gas gathering system and the water travelling downward to the pump inlet 26 as indicated by the arrows in FIG. 1. Water passes through the offset nipple 46 and the passageway 48 therein and past a standing ball valve 52 which is moved upwardly from the valve seat 54 with the water then passing into the interior of the pump housing 20. The pump has a retrievable nozzle and throat or mixing tube 56 positioned in a carrier 58 in a manner very similar to that disclosed in my U.S. Pat. No. 5,083,609 and various of the passages are not concentric as disclosed in the patent, the structure of this invention includes substantial differences with respect to the carrier and the standing valve 52.

The offset nipple 46 and passageway 48 enables the pump housing 20 to be situated in the discharge housing 28 in a nonconcentric manner with this offset arrangement making it necessary to arrange the parts in the pump housing in a concentric manner in order to prevent the outside diameter of the power fluid tubing 40 from interfering with the inside diameter of the production tubing 32 which surrounds it. If the pump is constructed to be operated without a discharge housing, it would be advantageous to offset the diffuser extension tube 60 and the constant radius, constant diameter discharge tube 62 and the upper seating bore 64 in the top component 36 of the pump housing as much as possible so as to provide the space necessary to accommodate the largest possible radius of the discharge tube 62.

The areas of the pump that are not removable with the nozzle carrier 58 and upper seating bore 64 which may be subject to wear from abrasion are coated with a hard surface material to provide the longest possible life before those parts must be pulled from the well. Specifically, the inside diameter of the diffusion extension tube 60 and the discharge tube 62 as well as the inside diameter of the discharge housing 28 in the area of the discharge port 50 would be provided with a hard surface material. The process that would be used to coat these surfaces would also coat all other surfaces of the treated parts which provides a beneficial effect of making them impervious to most corrosive materials.

Once the described parts have been placed in the well, piping is connected in the same manner as in U.S. Pat. No. 5,083,609 and high pressure fluid is pumped down the power fluid tube 40 through a plurality of ports 66 in the fishing neck 68 which is threaded into the top portion of the carrier housing 58 as indicated at 70. The fishing neck 68 also serves to secure the nozzle 72 onto its shoulder 74 on the carrier 58. This seating shoulder determines the spacing of the nozzle 72 above the top of the mixing tube 56 as well as providing a pressure seal. The mixing tube 56 is located and secured in place by interference or press fit in the upper areas 78 and the lower areas 80 of the carrier 58 and by chemical adhesive means in between the press fitted areas. The location of the carrier 58 is determined by the shoulder 82 which contacts a matching machined shoulder in the upper seating bore 64. This shoulder provides a positive mechanical fluid seal. Additional sealing is provided by one or more O-rings at 76. A further function of the shoulder 82 besides the aforementioned locating and sealing functions is that its greater diameter prevents the O-ring seals 83 immediately below it from contacting the walls of the power fluid tubing when the pump is traveling to or from the surface during pumping or retrieval. Likewise the shoulder 92 functions primarily to protect the O-ring seals 94 from similar damage.

As set forth in more detail in U.S. Pat. No. 5,083,609, the power fluid is forced through the nozzle 72 where the velocity increases and pressure decreases in the venturi area 84 with the reduction in pressure causing well product to enter the suction area of the system at the inlet end 26 and lift the ball valve 52 off of its seat 54 and enter suction chamber 86. The suction chamber 86 is unique in that there is no definitive crossover section, as in other jet pumps, to disrupt the fluid flow. Rather, the constant radius, constant diameter discharge tube 62 provides the maximum possible flow capacity through the area where the discharge and suction of prior jet pumps must "crossover" each other. When the well products reach the area above the diffuser extension tube 60, its velocity is reduced thereby increasing its pressure in the suction chamber. The full length of the carrier assembly 58 below the nozzle and above the diffuser extension tube 60 is exposed to the well product with this large open area tending to slow and stabilize the well product prior to its entering the plurality of ports 88 in the carrier assembly 58 at the venturi area 84 of the pump. The well product comes into contact with the high velocity stream exiting from the nozzle and is carried into the mixing tube 56 by that stream. The two fluids, the power fluid and the well product, reach a common velocity in this area and then enter the diffuser section of the pump which includes an increasing diameter. The portion of the diffuser tube that receives the most wear is retrieved with the throat and nozzle in the carrier. The velocity of the mixed fluid decreases as the diameter of the diffuser tube increases and the pressure of the mixed fluid increases with the diffuser tube providing an important result of allowing smooth transition from velocity to pressure inasmuch as violent turbulence in this area results in wasted energy and increased horse power requirements. The smooth transition flow is carried to conclusion as the mixed fluid exits the diffuser extension tube 60 and enters the constant radius, constant diameter discharge tube 62 which turns the fluid stream 90° to the discharge port 50. In other known jet pumps, this area would be called the crossover or transfer section because in other jet pumps there is usually a plurality of suction and discharge ports arranged in an alternating manner to accomplish this crossing of paths which typically utilize drilled holes intersecting at abrupt angles which introduce rather violent turbulent flow. This violent flow on prior jet pumps on the suction side contributes to cavitation and premature pump starvation and on the discharge side causes extra energy to be used in lifting the fluid back to the surface thus wasting energy and raising horse power requirements.

In this embodiment of the invention, the offsetting of the components within the system, the constant radius, constant diameter discharge tube, the free standing diffuser extension tube, the arrangement of the suction chamber above the extension tube and the absence of a definitive "crossover" or transfer section produces high efficiency operation without wasted energy and reduces horsepower requirements for a particular production capacity.

Figure 2:
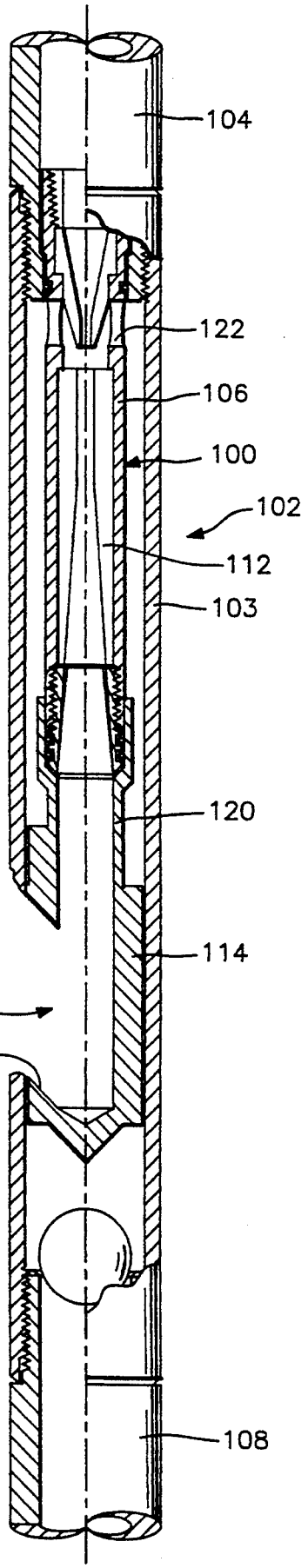
FIG. 2 is a vertical sectional view of a second embodiment of the invention.
Figure 3:
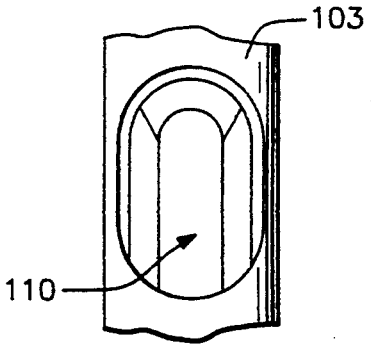
FIG. 3 is a fragmental elevational view illustrating the discharge of the pump at the diverter.

FIGS. 2–8 illustrate another variation of the jet pump disclosed in FIG. 1 which basically is a slim hole insert type free pump generally designated by references numeral 100 and includes a pump housing generally designated by reference numeral 102 including vertically arranged and threadedly connected tubular components 103, 104 and 108 and including a retrievable carrier 106 and a discharge area generally designated by reference numeral 110 which is the primary difference between this embodiment of the pump and the pump disclosed in FIG. 2. This pump can be run inside tubing as small as 2⅜ inch O.D. and must be kept as small as possible to allow the pump to pass through the special nipples normally utilized in a 2⅜ inch O.D. tubing while still providing sufficient annular area to conduct the combination spent power fluid and produced well product past the pump outside diameter when passing upwardly back to the surface through the production tubing.

While providing sufficient annular area, maximum suction area must also be maintained or production rates will suffer. In use, actual observed production rates on this pump exceed computer predictions for conventional jet pump operating under similar conditions.

Figure 4:
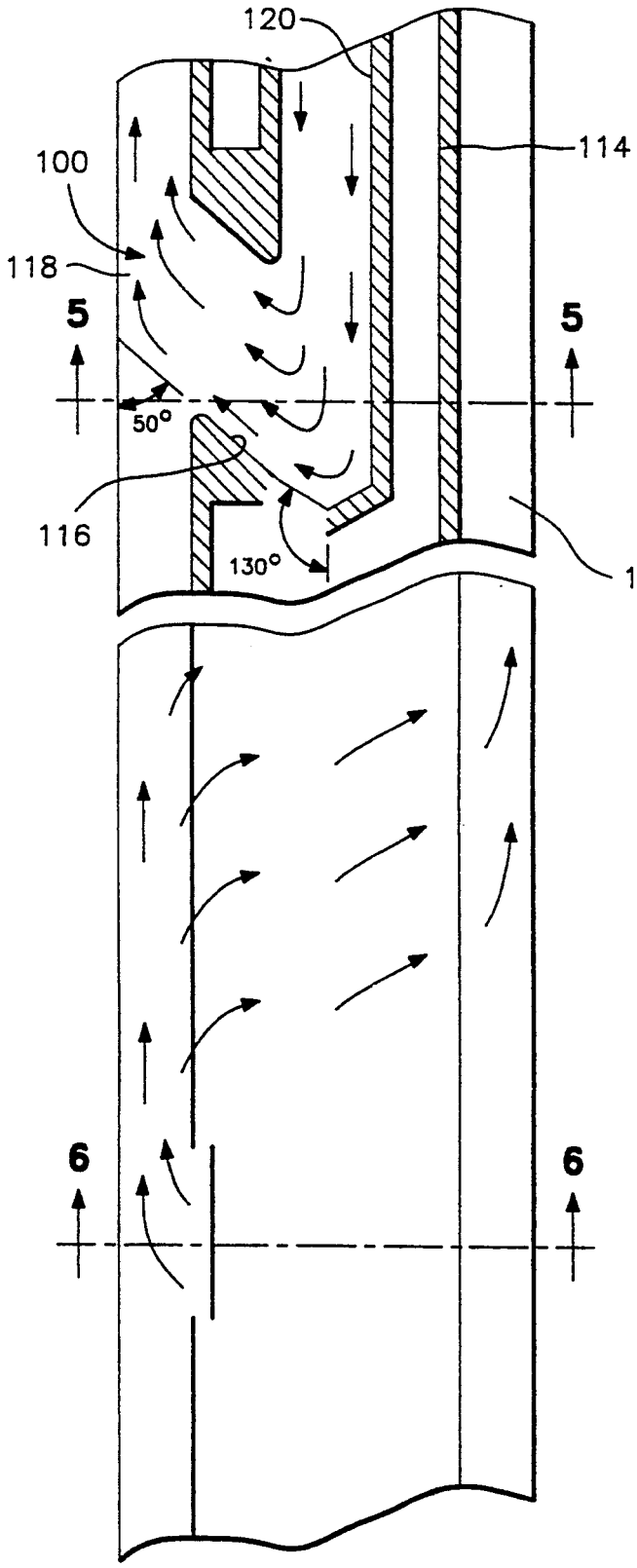
FIG. 4 is an enlarged fragmental view of the diverter.
Figure 5:
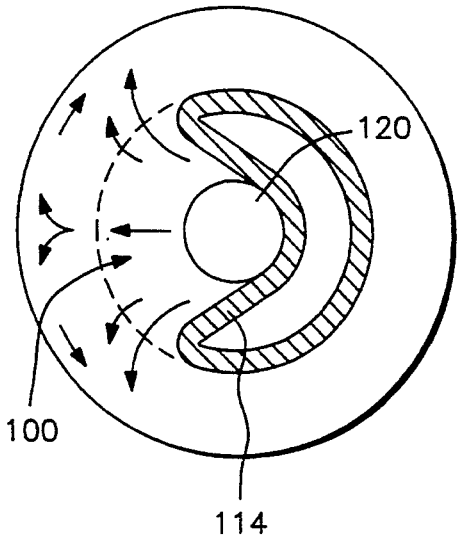
FIG. 5 is a transverse sectional view along section line 5—5 on FIG. 4 illustrating the structure thereof.
Figure 6:
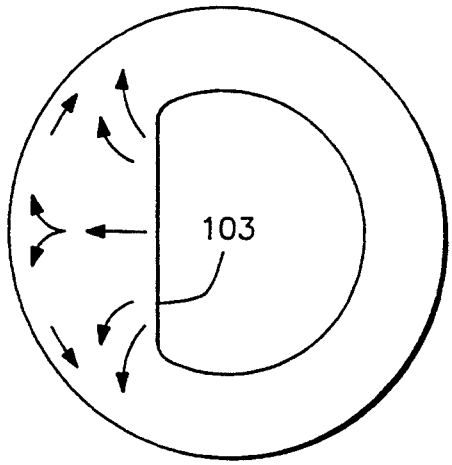
FIG. 6 is a transverse sectional view along section line 6—6 on FIG. 4 illustrating the structural details at that point.

In the jet pump art, there is a general rule of thumb that about 95% of the energy contained in the fluid leaving the straight section of the mixing tube will be recovered in three diameters of the throat. For example if the throat diameter is 0.200 inches, a diffuser with a discharge diameter of 0.600 inches will recover 95% of the energy present at the 0.200 inch diameter of that diffuser. The present construction makes best use of the remaining 5% of that energy and also makes the smoothest possible transition from the downflow exiting from the diffuser tube to an upward flow around the pump housing while making maximum use of the annular area around the pump housing. By straightening and confining the flow of fluid exiting the diffuser 112 before it enters the discharge area, the fluid tends to follow the back wall of a diverter 114 until it impinges on the angled floor 116 of the diverter 114. That portion of the fluid stream that contacts the angled floor 116 is then directed by the turning shape formed into the angled floor 116 to start what eventually becomes a 130° change of direction as illustrated in FIG. 4. That fluid then contacts the tubing wall 118 at about a 50° angle as illustrated in FIG. 4. The interior surfaces of the diverter 114 are coated with a wear resistant coating to withstand the direct flow coming from the diffuser 112. With this construction, the fluid contacting the wall of the tubing 118 does not impinge directly upon the surface at a 90° angle since it contacts it at about a 50° angle and this fluid has been considerably slowed in its progress with the diverter including a straightener 120 with fluid exiting the straightener 120 along its side walls and the open face of the discharge port 110 effected by the direction of flow of the fluid below the port and its tendency to diverge and slow fluid movement along the side walls of the diverter 114. As illustrated on the schematic diagrams in FIGS. 4–6, the flow travels not only upward and outward along the diverging walls of the discharge opening 110 but around the housing and up the annulus on the back side opposite the discharge port 110. The actual shape of the diverter floor 116 and the angles of the walls in the discharge opening or port 110 provide the best ratio of discharge to suction area which allows the area available for suction through the inlet 120 to equal the area of closest proximity to the inner wall of the housing component 103 and diverter 114, to exceed that available at the plurality of ports 122 in the carrier 106. This pump, in all other respects operates in the same manner as that in FIG. 2. This compact construction has significant advantages under certain conditions such as in remote locations in which jet pumps have been used in oil well operations. In Alaskan oil wells and in other remote locations, jet pumps have been used to alleviate the need for expensive and logistically difficult nitrogen lifting of various fluids from wells and various makes and models of jet pumps have been used with some degree of success. However, jet pumps in such installations have been limited to use with larger diameter tubing because there were no pumps available to move large volumes at high rates when using smaller diameter tubing or "macaroni" to convey the pump housing into the desired location within the well. No free style pump is available that satisfies the small size requirements and provides adequate capacities. Thus, the insert type housing disclosed can be conveyed on coiled tubing or threaded pipe yet still allow the retrievable feature of the free style pump without greatly sacrificing the pump rates possible. Not only does this pump have the ability to be conveyed by either "macaroni" or coil tubing with an inside diameter of less than 1 inch, its outside diameter of 1.660 inches makes it suitable for other applications as well.

Figure 7:
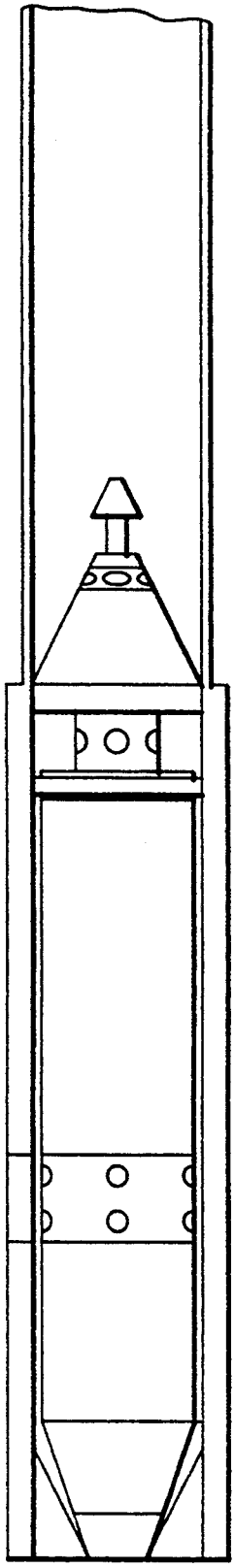
FIG. 7 (PRIOR ART)
FIG. 7 is a fragmental view illustrating the retrievable portion of a typical casing free jet pump.
Figure 8:
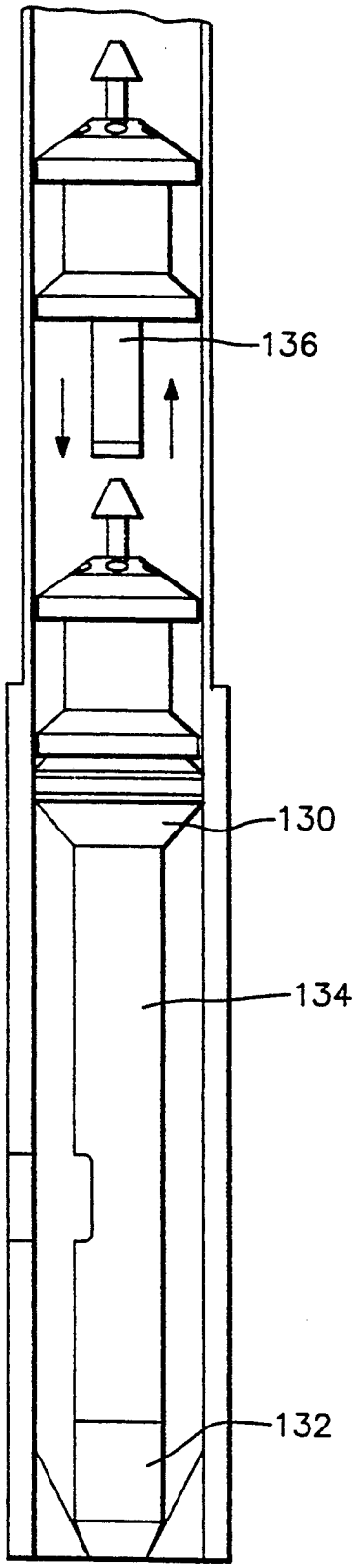
FIG. 8 is a schematic view illustrating the retrievable portion of the slim hole insert in a casing free arrangement.

As illustrated in FIG. 7 which illustrates prior art and FIG. 8, the top and bottom subs 130 and 132 are designed to position seals and shoulders in the proper locations so housing 134 can replace the retrievable pump assemblies of other free style pumps by seating in their respective pump cavities which are presently in use. Once the housing has replaced a retrievable pump, only the carrier 136 needs to be subsequently retrieved. Because of the present problem with respect to jet pumps frequently failing to reverse/circulate out of the power fluid tubing due to scale or sediment buildup above the free pump assembly and the close tolerance necessary due to the overall size of the pump in relation to the tubing, there is a need for a smaller, less complicated and less costly alternative. The lack of close tolerances because of the overall size of the free pump in relation to the tubing provides a smaller, less complicated and therefore less costly jet pump. In order to retrieve the pump of the present invention, only the carrier 136 need be retrieved. The carrier is usually less than 9 inches long and smaller than 1 inch outside diameter, the pump could be more readily retrieved and would most likely not be hampered by scale or sediment buildup. The smaller than 1 inch diameter of the insert could be provided with a swab cup on the carrier 136 to provide additional lift when retrieving.

Because on many remote locations or on offshore operations changing well conditions are often encountered which have caused reductions in oil or gas production, some form of artificial lift is necessary to sustain profitable operation of the well. Usually, the evaluation of the well in these circumstances is not economically feasible because of the prohibitive expense involved in using normal workover rigs and associated procedures. In such cases, the insert housing of this invention would be run inside the existing production tubing using coil tubing to convey the insert and other necessary seating, packing, release, bypass subs into position in the production tubing. The well then would be tested by pumping for a period of time necessary to evaluate its performance. If satisfactory, the coil tubing could be left with the pump as a permanent free type down hole jet pump and the only other item that would be required is the installation of permanent surface facilities at a substantial less cost than use of a workover rig. The same procedure as described above can be used to reduce, alleviate or eliminate the use of nitrogen to unload or remove workover or other fluids from a well which, in most cases, the saving in time and dollars would justify this operation and this would be particularly true where logistics and required large amounts of nitrogen would indicate the use of this invention. This insert pump would also replace rod pumps that have proven to be too costly in down time, workover expense or simply cannot provide sufficient fluid pumping capacity with the insert pump replacing the down hole portion of the rod pump with coil or macaroni tubing replacing the rods string with the surface equipment also being correspondingly changed.

Figure 9:
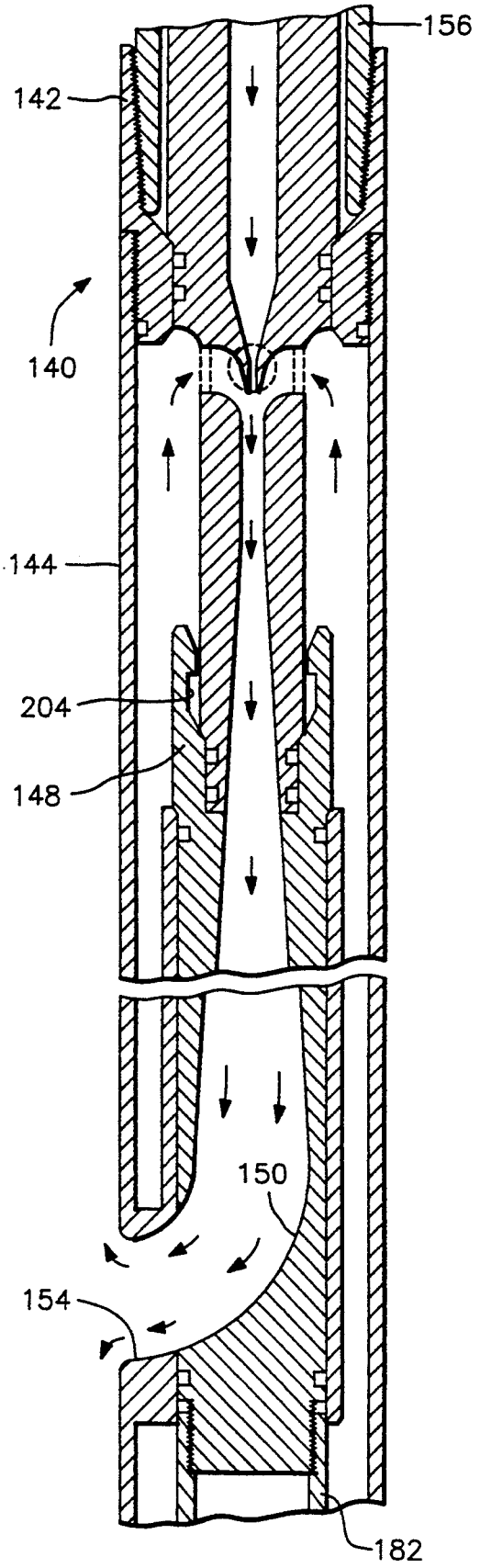
FIG. 9 is a sectional view illustrating a third embodiment of the jet pump.
Figure 11:
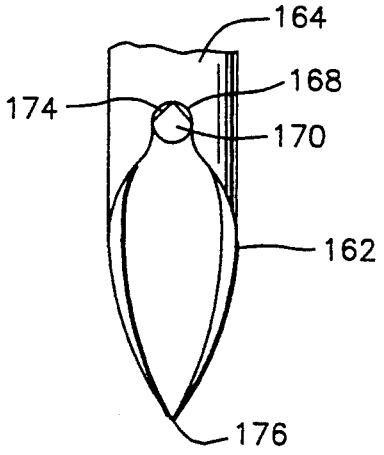
FIG. 11 is a fragmental elevational view structure which indexes the discharge portion of the pump assembly.
Figure 10:
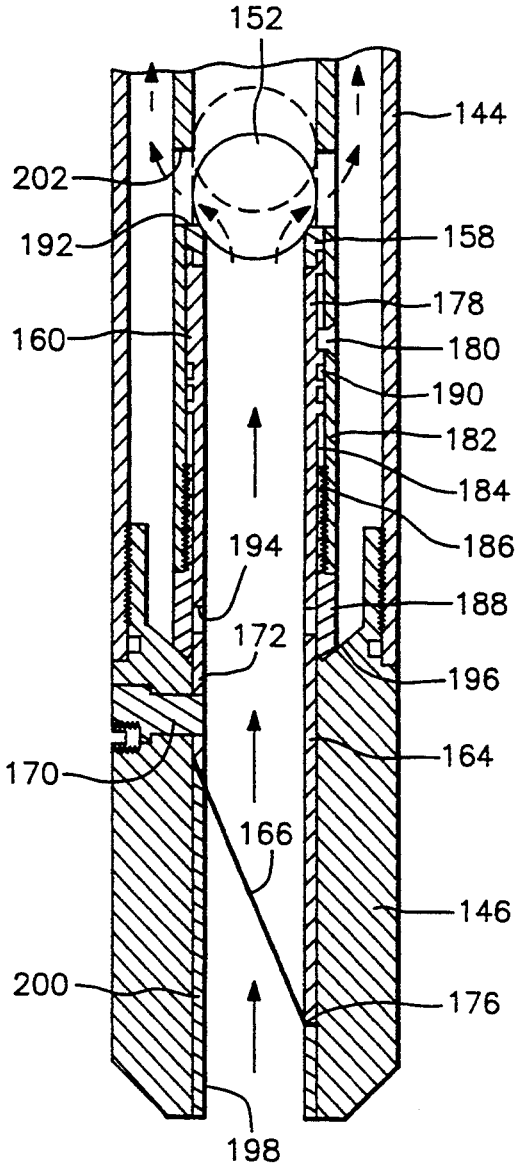
FIG. 10 is a detailed sectional view illustrating the lower portion of the jet pump which forms a continuation of the lower end of FIG. 9.

FIGS. 9–11 discloses another embodiment of the jet pump generally designated by reference numeral 140 which provides a unique arrangement for recovering pump housing components including the diffuser extension tube 148, the constant radius, constant diameter discharge tube 150, 152, 158, 164 and all other parts attached to 148 without the necessity of pulling the pump housing components 142, 144 and 146 and the power fluid tubing 156 from the well. This function is accomplished by having those parts inserted as a unit into the housing with the insert including several unique features which accomplishes this function.

Discharge from the pump takes place through a single discharge opening 154 which has a constant radius, constant diameter discharge tube 150 communicating therewith with the tube 150 necessarily being perfectly aligned both radially and longitudinally with the discharge port 154 which remains as a part of the housing component 144. It is also necessary to provide a cage for the standing ball valve 152 to prevent it being separated from its valve seat 158. And it will be necessary to relieve the fluid head all of which are accomplished by a sliding sleeve equalizing and indexing tube 160 that is located below and becomes part of the previously mentioned retrievable insert.

The structure to index the discharge portion of the assembly radially is in the form of a mule shoe 162 formed on the bottom portion of an innermost tube 164 with the mule shoe being defined by a diagonal inclined edge 166 on the bottom of the tube 164 with the uppermost portion of this inclined edge including a notch or slot 168 at the apex of the curved upper edge of the inclined edge which engages a pin 170 protruding from the internal wall of the passageway or hole 172 in which the tube 164 is inserted. The end of the pin 170 which protrudes into the passageway 170 has a knife edge as indicated by reference numeral 174 at its upper surface so as to provide a knife edge or a very small point of contact to the pointed lower end 176 of the mule shoe 162 or inclined edge 166 with the lower edge 176 being pointed as a result of the taper from the shape of the mule shoe which will cause the tube 164 on which it is formed to rotate in one direction or the other when the taper comes into contact with the protruding pin 170. Specifically the pointed lower tapered end 176 of the mule shoe will contact the upper knife edge portion 174 of the pin 170 so that the tube 164 will rotate as it travels downwardly until the pin 170 enters the slot 168 at the apex of the mule shoe. The slot 168 and the pin 170 are so positioned to exactly align with the center of the discharge port 154 in the housing component 144.

The upper end of the tube 164 which has the mule shoe 162 on the lower end thereof has the valve seat 158 thereon for receiving the standing valve ball 152. Also, a key slot 178 is provided in the exterior surface thereof to receive an indexing pin 180 rigid with and projecting inwardly from an outermost sliding sleeve tube 182 to enable relative sliding movement between the tubes 164 and 182 with the tube or sleeve 164 including a stop shoulder 184 which coacts with a shoulder 186 formed on the upper end of bushing 188 thus providing a limited longitudinal movement of the tube 164 and sleeve 182. O-ring seals 190 are positioned between the external surface of the tube 164 and the internal surface of sleeve 182. The upward travel of the innermost tube 164 is limited by shoulder 192 formed in the outermost tube or sleeve 182 and the upper surface of the ball seat 158 in the innermost tube 164. The pin 180 and the slot 178 which receives the inner end of the pin prevents relative rotation of the tubes 164 and 182 relative to each other. A plurality of holes 194 are provided in the innermost tube 164 which are located behind and close to the bottom of the seal and shoulder bushing 188. When the seal and shoulder bushing 188 is resting on its seat 196 and the bottom plug 146 forming the lower end of the housing component, fluid is prevented from entering the hole from below by the seal established by the shoulder bushing 188 engaging its seat 196 on the plug 146 and from above by the standing ball valve 152 on its seat 158 and the seals 190 between the concentric tubes 164 and 182.

When pumping, fluid enters the opening 198 in the bottom of the reverse mule shoe 200 and passes through the mule shoe and travels upwardly through the innermost tube 164 and lifts the standing valve ball 152 off its seat 158 and then enters the outermost tube 182 of the sliding sleeve equalizing and indexing tube. The fluid then exits the tube 182 through a plurality of ports 202 formed around the sides of the tube 182. The remainder of the fluid flow is same as in the previously disclosed pumps and all of the functions including pumping down and retrieving the free or retrievable housing containing the nozzle and throat or mixing tube remains the same. The power fluid tubing must be of sufficient diameter to allow the insert to pass through it when it is retrieved or inserted. It is not necessary to provide latching or other holddown means to secure the insert in position in the housing as pressure provided to the free pump to operate it holds it on the seat 158 and consequently the insert is held on its seat which is located at the shoulder bushing 188 engaging the seat 196 on the bottom plug 146. When not pumping or when pumping in reverse to receive the free pump, the insert is held on its seat by the hydrostatic head pressure and the force exerted by that pressure on the standing valve ball 152 on its seat 158 and to the seals 182 and the sliding sleeve equalizing and indexing tube.

To retrieve the insert, the same procedures are performed as in the pump disclosed in U.S. Pat. No. 5,083,609 and in the pump disclosed in FIG. 2. When retrieval has been accomplished, a tool having external latches constructed to match with and latch into the inside profile 204 formed in the top of the insert is conducted by wire line or coiled tubing means through the power fluid tubing, through the bore in the top of the sub 142 of the pump housing and into place to latch into the profile 204. When that procedure is completed, an upward pulling force is exerted on the insert of sufficient magnitude to overcome the resistance of the seals 190 and indexing pin 180 of the sliding sleeve equalizing and indexing tube. The full force of the hydrostatic head is exerted on the standing valve ball 152, its seat 158, the innermost tube 164 and the reversed mule shoe 200 on which the tube 164 rests. When sufficient upward force has been applied, the insert will move vertically upward lifting the seal and shoulder bushing 188 which is attached to the outermost tube 182 off the seat 196 in the bottom plug 146 thus exposing the plurality of holes 194 in the innermost tube 164 which in turn communicates with the inner passage of the tube 164 and then with the opening 198 in the bottom plug 146. This position is maintained until the hydrostatic pressure on either side of the standing valve ball 152 is equalized. At that time, the insert may be extracted from the pump housing and then to the surface. The insert is replaced by reversing the above outlined procedure.

All of the embodiments of this invention provide more effective utilization of the power fluid by more efficient energy use with the structures illustrated in FIGS. 1–8 being retrievable by reverse flow and the insert in FIGS. 8 and 9 being retrieved by a wire line or coil tubing. This enables the components of the pump to be adjusted or replaced to vary the operational characterists of the jet pump for optimum operating conditions.

The foregoing is considered as illustrative only of the principles of the invention. Further, since numerous modifications and changes will readily occur to those skilled in the art, it is nor desired to limit the invention to the exact construction and operation shown and described, and, accordingly, all suitable modifications and equivalents may be resorted to, falling within the scope of the invention.

What is claimed as new is as follows:

1. In a jet pump for use in a well extending into a fluid producing formation, said jet pump including a housing having an inlet at a lower end thereof, a standing valve assembly associated with the inlet and a nozzle, venturi and diffuser for receiving power fluid and port means communicated with the inlet through the standing valve for pumping production fluid and mixing it with the power fluid, the improvement comprising a discharge tube forming an extension of the diffuser and communicating with a discharge port in the pump housing, said discharge tube including a laterally extending portion communicating with the discharge port to provide flow through the crossover area of the pump where the discharge from the pump and the inlet to the pump through the standing valve are longitudinally inter-related, said inlet and standing valve and jet pump being offset in relation to the center line of a well casing to provide maximum discharge area for the pump with minimum restriction, said pump including a discharge housing enclosing the pump and including a bottom plug having the pump inlet incorporated therein with the discharge housing defining an annulus for upward flow of mixed production fluid and power fluid with the pump being offset in relation to the discharge housing to provide maximum flow capacity.

2. The pump as defined in claim 1 wherein said pump nozzle, venturi and diffuser are mounted in a carrier and are retrievable by reverse flow of fluid down said annulus and into the discharge tube to enable the jet pump components to be retrieved, replaced or adjusted.

3. The pump as defined in claim 1 wherein said discharge tube includes a fluid flow straightening portion and a diverter at the lower end thereof forming said laterally extending portion and communicating with said discharge port for reversing the flow direction in the discharge tube and discharging flow in an upward angular direction toward the well casing.

4. The pump as defined in claim 3 wherein said diverter includes an angled floor for impingement of flow from the jet pump with the angled floor including an outer portion which is upwardly angled in the direction of discharge of flow upwardly between said casing and jet pump.

5. The jet pump as defined in claim 4 wherein said diverter includes a laterally opening area defined by outwardly diverging walls above said floor communicated with a vertically elongated discharge port to provide flow from the pump to the discharge port.

6. The jet pump as defined in claim 1 wherein said nozzle, venturi and diffuser are releasably and sealingly connected with a diffuser tube extension, said laterally extending portion of the discharge tube curving laterally and engaging the discharge port enabling removal of the jet pump, said diffuser extension and discharge tube including a profile to enable these components to be removed, said diffuser tube and discharge tube forming a removable insert having the standing valve associated therewith, said standing valve including a valve seat and a pair of concentrically arranged tubes provided with an inlet at the bottom and means rotating the tubes in response to relative movement of the concentric tubes to align components of the insert for inlet flow of production fluid, mixing production fluid with power fluid in the pump and discharging mixed production fluid and power fluid for discharge through the discharge port.

7. A jet pump for use in a well extending into a fluid producing formation, said jet pump including a housing having a production fluid inlet at a lower end thereof, a standing valve assembly associated with the inlet to enable inflow of production fluid into said housing, a nozzle, venturi and diffuser for receiving power fluid from a pressurized source, port means communicating the venturi with the housing to enable inflow of production fluid and mixing it with the power fluid, a discharge tube forming an extension of the diffuser and communicating with a discharge port in the pump housing, said discharge tube providing a flow path through the area of the pump where the discharge from the pump and the inlet to the pump through the standing valve assembly are longitudinally related, said inlet and standing valve and jet pump housing being offset in relation to the center line of a well casing to provide maximum discharge area for the pump with minimum restriction, said pump including a discharge housing generally concentric with the casing and spaced therefrom, said discharge housing enclosing the pump housing and including a bottom plug having the pump inlet and standing valve assembly incorporated therein, said discharge housing being connected with production tubing extending to ground surface and offset in relation to power fluid supply tubing and defining an annulus for upward flow of mixed production fluid and power fluid with the pump being offset in relation to the discharge housing to provide maximum flow capacity.

8. The pump as defined in claim 7 wherein said pump nozzle, venturi and diffuser are mounted in a carrier removably supported in said pump housing, said carrier being retrievable by reverse flow of fluid down the annulus and into the discharge tube to enable the jet pump components to be retrieved, replaced or adjusted.

9. The pump as defined in claim 7 wherein said discharge tube means includes a fluid flow straightening portion and a diverter at the lower end thereof communicating with said discharge port for changing the flow direction in the discharge tube and discharging flow in an upward angular direction for movement toward ground surface.

10. The pump as defined in claim 9 wherein said diverter includes an angled floor for impingement of flow from the jet pump diffuser with the angled floor including an outer portion which is upwardly angled in the direction of discharge of flow upwardly between a casing and jet pump.

11. The jet pump as defined in claim 10 wherein said diverter includes a lateral opening defined by outwardly diverging side walls communicated with a vertically elongated discharge port to provide maximum flow from the pump to said discharge port.

12. The jet pump as defined in claim 8 wherein said carrier is provided with at least one peripheral downwardly facing shoulder and peripheral sealing means on said carrier below said shoulder, said sealing means including a periphery radially inwardly of the shoulder thereby preventing the sealing means from coming into contact with interior wall surface of tubing or housings through which the carrier must pass when positioning the carrier within said pump housing, said shoulder also providing a positive stop and a sealing surface when in contact with a corresponding upwardly facing shoulder on said pump housing.

* * * * *